United States Patent [19]

Van Bogaert et al.

[11] Patent Number: 4,715,411

[45] Date of Patent: Dec. 29, 1987

[54] SPEED CONTROL FOR WEFT FEED SPOOL IN WEAVING LOOMS

[75] Inventors: Philippe Van Bogaert, Brussels; Filip Deconinck, Zwevegem, both of Belgium

[73] Assignee: Picanol N.V., Belgium

[21] Appl. No.: 765,221

[22] Filed: Aug. 13, 1985

[30] Foreign Application Priority Data

Sep. 4, 1984 [BE] Belgium ..... 2/60490

[51] Int. Cl.[4] ..... D03D 47/36; B65H 51/20

[52] U.S. Cl. ..... 139/452; 242/47.01

[58] Field of Search ..... 139/452; 242/47.01, 242/47.12, 47.13

[56] References Cited

U.S. PATENT DOCUMENTS 3,225,446 12/1965 Sarfati et al. .
3,411,548 11/1968 Pfarrwaller .
4,226,379 10/1980 Brouwer et al. .
4,298,172 11/1981 Hellstrom .
4,541,462 9/1985 Tholander ..... 139/452
4,556,088 12/1985 Tanaka et al. ..... 139/452
4,558,723 12/1985 Tanaka et al. ..... 139/452
4,595,039 6/1986 Tholander ..... 139/452
4,617,971 10/1986 Hellstroem ..... 139/452

FOREIGN PATENT DOCUMENTS 0094099 11/1983 European Pat. Off. ..... 139/452

*Primary Examiner*—Harvey C. Hornsby
*Assistant Examiner*—Joseph S. Machuga
*Attorney, Agent, or Firm*—Bacon & Thomas

[57] ABSTRACT

A method to control the speed of the weft feed spool in weaving looms includes feeding at least two items of detected data related to weft delivery and supply, and loom operation, into a control mechanism, and using the data to calculate as a number of windings, the variation of the weft length reserve from the average minimum desired weft length reserve as determined by an average weft length reserve sensor and adjusting the speed of the feed spool in response to such calculations. A maximum weft length detector may be used as a control for the feed spool as well as a sensor for the time and number of unwindings of weft from the feed spool.

8 Claims, 2 Drawing Figures

SPEED CONTROL FOR WEFT FEED SPOOL IN WEAVING LOOMS

This invention concerns a speed control for the weft feed spool in weaving looms, i.e., to the mechanism used on jet looms to form a reserve weft thread during the time when a weft is introduced into the shed motion, in which such a control may be applied to feed spools with both fixed and rotatable spindles.

In a specific application, this invention concerns a drive for such a feed spool which is independent of the loom shaft, with its own speed control, by which the weft thread is wound through a hollow shaft onto a spindle by means of an arm in order to obtain successive windings which lie side by side and slide forward axially. The windings thus wound onto the spindle are retained using a magnetic pin, and freed as each weft thread is inserted by the temporary withdrawal of this magnetic pin, after which the weft thread thus formed is blown into the shed motion by means of the main jet. As is already known, correct adjustment of the opening and closing time of the aforementioned magnet enables a specific number of windings to be taken off each loom cycle, in which the time duration for this magnet may be a fixed adjustment or an adjustment regulated according to the actual weft thread insertion speed.

Under normal circumstances the windings are wound side by side on the spindle of the weft feed spool until a specific number of reserve threads are obtained with a predetermined axial length and which thread reserve can regularly be drawn off without any breaks occurring.

However, it is known that the aforementioned windings are not always spooled off properly side by side, and it is possible for a winding to be pushed partially over or under a preceding winding due to a number of reasons including:

- a widely varying thread reserve;
- an irregular spooling tension in the weft thread caused by wide variation in the unspooling speed of the bobbin;
- by too large a thread reserve, which then forms a large resistance against the windings sliding forward axially on the spindle;
- etc.

It is evident that when these windings are spooled off the spindle of the weft feed spool during insertion, either breaks occur or two or more windings are unspooled simultaneously, which always causes weaving faults such as a non-extended thread, a weft thread which is too short or a weft thread which is too long.

It is evident that the axial length of the reserve windings on the spindle is directly related to the number of reserve windings which make up this axial length.

The adjustment of the aforementioned number of reserve windings is always regulated by the adjustment of the instantaneous spooling speed of the weft feed spool to the average unspooling speed, in which allowance must be made for the fact that the unspooling speed can vary widely during weaving according to the colour repeat of the weft thread on one hand and the stop/star condition of the weaving loom on the other hand.

It is thus observed here that the prime concern is to maintain the thread reserve on the feed spool as constant and as small as possible.

Various solutions have already been proposed in order to achieve all this.

One of these solutions, as is the case for example in the U.S. Pat. Nos. 3,225,446 and 3,411,548, consists of the use of an optical sensor with a wide working angle, which supplies a signal giving information relating to the weft thread reserve measured axially on the spindle, and where this signal serves as the basis for regulation of the rotational speed of the feed spool drive motor.

The disadvantages of this solution are that when the weaving loom stops, the feed spool is stopped very abruptly, that the adjustment of the regulator is difficult because the observation of the axial length of the thread reserve is not a definitive measure of the number of windings wound onto the spindle since this axial length is independent of the weft thread diameter, and that the wide viewing angle of the sensor renders it difficult to maintain the thread reserve as small as possible.

Another solution uses a mechanical sensor, as for example in U.S. Pat. No. 4,226,379, in which this sensor detects the presence of an excess number of windings and consequently sends a signal to the drive motor which causes the speed of this motor to be altered, taking into account the frequency of overwinding and time duration in order to return to the normal reserve.

Especially where very fine yarns are involved, such a regulation in the vicinity of the maximum will give an unacceptable number of reserve windings, even when the mechanical sensor is replaced by an optical sensor.

Yet another solution, for which see U.S. Pat. No. 4,298,172, consists of the use of a minimum and a maximum sensor which are situated at an adjustable distance from each other and by means of which the speed is adjusted to a minimum or maximum speed when the reserve exceeds the maximum or falls under the minimum respectively, these speeds being calculated from the time duration and the overwinding frequency, as was practically the case in the example referred to previously.

A disadvantage of this solution is that here the reserve will develop around either the minimum or the maximum sensor and, since for correct control using this system both sensors are best placed a few millimeters apart from each other, the weft thread reserve will never be adjusted to be very small and regular.

The general conclusion to be drawn from the foregoing is that firstly the use of the axial reserve length of the weft thread as a measure for the determination of this reserve does not provide any definitive information in relation to the number of reserve windings, and that secondly the use of a sensor with a wide viewing angle or the use of a minimum and a maximum sensor does not enable the reserve to be adjusted to a minimum.

Due to the development of digital control techniques, it is possible to calculate the number of reserve windings present on the spindle from the difference between the number of windings wound, which is known from the number of rotation pulses of the feed spool drive shaft, and the number of windings spooled off during the insertion cycle of the weaving loom.

However, such a control is extremely delicate and requires additional processing. Thus when errors occur in the detection of the number of windings, the accumulated error can become very large, and when the weft thread on the spindle breaks, the entire thread reserve has to be removed and the control mechanisms have to be reset to zero windings.

With the objective of systematically eliminating the aforementioned and other disadvantages of the existing speed controls for feed spools, the invention proposes a method which consists of feeding at least two items of detected data into a control mechanism and the use of these data by the control mechanism to calculate, as a number of windings, the variation of the actual reserve from the desired minimum average reserve as determined by a reserve sensor and to adjust the speed of the feed spool in response to such calculations.

The aforementioned data may be constituted by:

- the number of windings per weft thread, for example in the form of a numerical switch with 8 selections and/or a specific detection during weaving;
- the speed of the motor, for example by means of a numerical switch with 16 selections;
- pulse signals per rotation of the feed spool, for example by means of a sensor;
- start/stop status of the weaving loom;
- the weft release signal for the respective weft feed spool, in other words for the colour feed.

Moreover, the aforementioned method will use sensors to supply data to the aforementioned control mechanism, such as:

- a reserve sensor with a very narrow viewing angle, situated at an average desired minimum axial reserve length corresponding with an average number of windings wound on in the stationary condition;
- a maximum sensor as protection against oversupply of the feed spool;
- a winding sensor which measures the time and the number of windings unspooled in the loom cycle, which also uses this sensor at the same time as a maximum sensor as protection against oversupply of the feed spool.

Ultimately, the signal produced by the aforementioned control mechanism can also be used if desired to control the braking force of the feed spool input brake, whereby the braking force on the weft will be inversely proportional to the speed of revolution of the feed spool. Thus, at high speed or low speed of the spindle, the tension is uniform.

Figure 1:
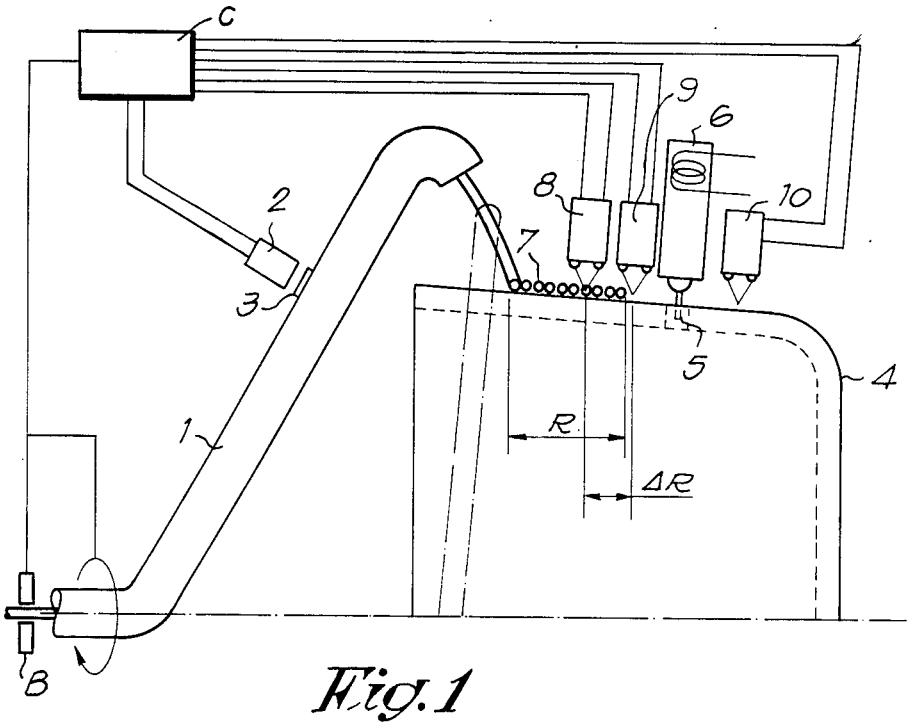
FIG. 1 shows an embodiment of the invention using a stationary spindle.

In FIG. 1, the hollow arm 1 of the feed spool is shown, opposite which a sensor 2 is situated, e.g. a Hall sensor which reacts to a magnetic force field supplied for example by a magnet 3 attached to the arm 1 for sensing revolutions of arm 1.

The feed spool spindle 4 acts together with the pin 5 of the magnet 6, which determines when the windings 7 can be taken off the spindle, and in this case sensors 8, 9 and 10, a reserve sensor, a maximum sensor and a winding sensor respectively, are fitted opposite this spindle 4.

Sensor 8 here is located at the normal desired minimum thread reserve; sensor 9 is located at the maximum thread reserve and sensor 10 detects the number of windings 7 which leave the spindle 4.

The actual axial reserve length is shown by R in this sketch, while the potential variation of the reserve is indicated by ΔR (between sensors 8 and 9).

Figure 2:
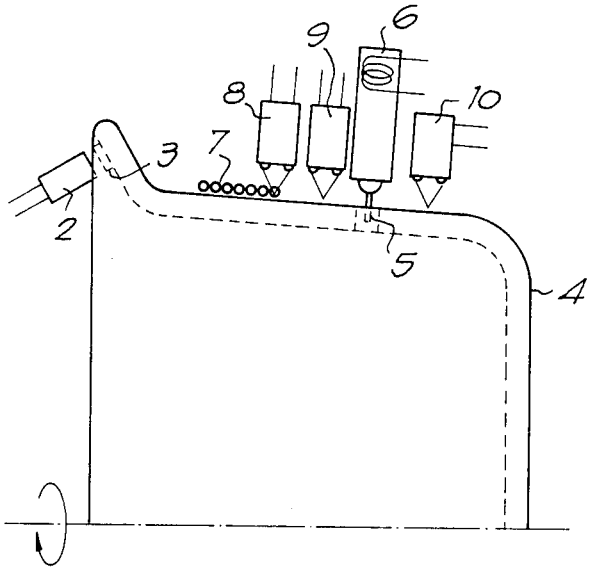
FIG. 2 shows an embodiment using a mobile spindle.

The same is thus shown in FIG. 2, with the exception of the location of the sensor 2, which now acts together with the spindle 4.

For the sake of completeness, a further number of separate remarks will be given below as non-restrictive example of the method according to the invention.

During the normal running of the weaving loom, the speed of the feed spool is adjusted so that the variation ΔR, expressed as a number of windings, is between one weft thread too few and one weft thread too many.

During the running of the weaving loom, an oversupply can develop on the feed spool as a result of the fact that the the control mechanism according to the invention receives pulses from the aforementioned sensor 10 which arise from dust moving within the detection area of the aforementioned sensor 10 and/or which is present on the spindle of the feed spool.

In this situation, when the maximum sensor 9 detects the maximum number of windings 7, the feed spool will stop, until the minimum sensor or, in the application shown in the sketches, the reserve sensor 8, detects were upon the minimum number of windings 7, the feed spool will start up again in the normal starting manner with the variation ΔR of the reserve supply equal to zero.

When the winding sensor 10 does not detect any windings 7 being released from the spindle 4, an undersupply occurs.

When this is not the case and the minimum or reserve sensor 8 does not detect any windings, then the feed spool will be driven at a high speed until sensor 8 detects windings again, at which stage ΔR is brought back to zero and the feed spool returns to normal speed.

When the weaving loom stops and sensor 8 detects windings, then the feed spool will also be stopped.

When the weaving loom stops and sensor 8 does not detect any windings, then the feed spool will continue to rotate until the aforementioned sensor 8 detects windings again. This continued rotation can be at full speed if desired, after which the feed spool stops.

When the weaving loom stops and a number of windings are released from the feed spool, then this latter will continue to rotate at low speed until the aforementioned sensor 8 detects windings, after which it will quickly stop.

At this stage ΔR can be reset to zero if desired when sensor 8 detects the aforementioned windings 7.

When the weaving loom starts up again, the feed spool will restart after pin 5 of magnet 6 has been withdrawn and minimum sensor 8 does not detect any windings.

Finally the conditions during the start-up of the weaving loom are equivalent to the conditions when the loom is stopped, whereby the variation ΔR of the reserve supply expressed as a number of windings is returned to zero the first time the reserve supply reaches its minimum value.

We claim:

1. A method for controlling the speed of a weft feed spool in a weaving loom comprising:

- detecting at least two items of data related to weft delivery and supply, and loom operation;
- detecting by a weft reserve sensor the average minimum desired length of weft reserve on the spool;
- calculating from the detected data the variation from the average minimum desired reserve in terms of number of windings on the spool;
- calculating, as a function of the calculated variance in the number of windings from the average minimum reserve, any adjustment needed to the speed of the weft feed spool;

controlling the weft feed spool speed as a function of said calculated adjustment.

2. A method as claimed in claim 1, including assigning the value of zero to the calculated variance whenever the signal of the weft reserve sensor changes its state, specifically, whenever the signal changes from "detection of no thread" into "detection of thread" and vice versa.

3. A method as claimed in claim 1 or 2 wherein said items of data are selected from:

(i) the number of windings per weft thread;

(ii) the maximum speed of the feed spool;

(iii) pulse signals based on rotation of the feed spool;

(iv) the start and stop status of the loom; and (v) the weft release signal for the weft feed spool.

4. A method as claimed in claims 1 or 2, wherein said items of data are selected from:

(i) the number of windings per weft thread;

(ii) the maximum speed of the feed spool;

(iii) pulse signals based on rotation of the feed spool;

(iv) the start and stop status of the loom; and (v) the weft release signal for the weft feed spool;

and wherein the weft reserve sensor is located at the location of the winding at an average minimum desired axial length wound on the spool in stationary condition.

5. A method as claimed in claim 1 or 2, including detecting a maximum length of weft reserve by a maximum reserve length sensor and adjusting the speed of the weft feed spool in response to a detected oversupply condition.

6. A method as claimed in claim 5, including detecting the time for and number of windings unspooled during a pick in the loom cycle.

7. A method as claimed in claim 1 or 2, wherein said items of data are selected from:

(i) the number of windings per weft thread;

(ii) the maximum speed of the feed spool;

(iii) pulse signals based on rotation of the feed spool;

(iv) the start and stop status of the loom; and (v) the weft release signal for the weft feed spool;

and including detecting a maximum length of weft reserve by a maximum reserve length sensor and adjusting the speed of the weft feed spool in response to a detected oversupply condition.

8. A method as claimed in claim 1 or 2, wherein braking force exerted by a brake for weft input to the spool is adjusted so as to be inversely proportional to the speed of the weft feed spool.

* * * * *